United States Patent [19]

Mori et al.

[11] Patent Number: 4,570,697

[45] Date of Patent: Feb. 18, 1986

[54] METHOD OF TREATING FINAL CONTINUOUS CAST STRAND IN A HORIZONTAL CONTINUOUS CASTING PROCESS

[75] Inventors: Takasuke Mori, Hyogo; Jun Miyazaki, Kobe; Hitoshi Nakata, Osaka, all of Japan

[73] Assignee: Kabushiki Kaisha Kobe Seiko Sho, Kobe, Japan

[21] Appl. No.: 571,694

[22] Filed: Jan. 18, 1984

[30] Foreign Application Priority Data

Jan. 18, 1983 [JP] Japan ..... 58-7132

[51] Int. Cl.[4] ..... B22D 11/16

[52] U.S. Cl. ..... 164/484; 164/413

[58] Field of Search ..... 164/484, 413, 483, 454

[56] References Cited

U.S. PATENT DOCUMENTS 3,817,313 6/1974 Gamble ..... 164/483

FOREIGN PATENT DOCUMENTS 468691 4/1975 U.S.S.R. ..... 164/483

*Primary Examiner*—Nicholas P. Godici
*Assistant Examiner*—Gerard M. Reid
*Attorney, Agent, or Firm*—Oblon, Fisher, Spivak, McClelland & Maier

[57] ABSTRACT

A method of treating a continuous cast strand in a horizontal continuous casting process wherein when the level of molten steel within a tundish becomes lower than a prescribed level at a portion near the upper surface of a tundish nozzle at final stage of the casting process, drawing of the continuous cast strand is discontinued, and after a lapse of a specified time the drawing of the continuous cast strand is again performed and the strand is broken at the feed nozzle.

3 Claims, 5 Drawing Figures

METHOD OF TREATING FINAL CONTINUOUS CAST STRAND IN A HORIZONTAL CONTINUOUS CASTING PROCESS

BACKGROUND OF THE INVENTION

1. Field of the Invention

The present invention relates to a horizontal continuous casting process, and more particularly to a method of smoothly and efficiently treating a continuously cast strand (c.c strand) in a final stage in the casting process.

2. Description of the Prior Art

FIG. 1 shows a schematic longitudinal sectional view illustrating a horizontal continuous casting state as an example of the prior art. In the figure, molten steel M within a tundish 1 is drawn intermittently through a tundish nozzle 2, a feed nozzle 3 arranged in coaxial relation with the tundish nozzle 2, a connecting refractory material 4 and a mold 5 to the left in the figure. During the drawing process, the molten steel M is sequentially solidified from the exterior of the steel towards the interior. Such horizontal continuous casting technology has a problem in the treatment of the c.c. strand at a final stage. The final stage includes the stage where the amount of molten steel remaining in the tundish 1 becomes relatively small and the level of the molten steel begins to become lower than the upper surface of the tundish nozzle 2. In this stage, since the pressure effect from molten steel in the tundish is lost, defects in the c.c. strand may occur and in an extreme case breakage of the solidified shell may cause leakage of molten steel. In order to avoid such problem, the following various methods have been proposed. These methods have respective disadvantages as hereinafter described and therefore cannot entirely comply with requirements in practical use.

The first conventional method is a method in which the drawing speed of the c.c. strand is reduced at the final stage of casting and drawing is performed while preventing leakage of molten steel caused by insufficient solidification.

In this method, since the lack of a pressure effect in itself is not eliminated, the defect of a long cavity may be produced in the final c.c. strand and the yield can be reduced. Moreover, the solidification front is transferred to the feed nozzle and therefore the refractory material at the front nozzle may be significantly broken and a solidified substance (fin) may penetrate to the broken portion so as to cause dammage to the mold and in an extreme case may prevent draining to occur.

A second conventional method involves a method in which the tundish nozzle is closed by a shutter mechanism or a stopper in the final stage of casting and any molten steel remaining in the mold is drawn at low speed during solidifying of the molten steel.

Installation of a closing mechanism such as a shutter mechanism or a stopper in the tundish nozzle is quite difficult from a structural viewpoint. Moreover, since the tundish nozzle is broken after each casting process and then reconstructed, installation of such a complicated closing mechanism in each reconstruction is quite uneconomical and not practicable.

A third conventional method concerns a method in which the drawing of the c.c. strand is stopped at the final stage of casting, molten steel in the mold and the tundish nozzle is completely solidified the c.c. strand is then cut at the outlet of the mold, and the c.c. strand remaining in the mold is removed from the mold after being completely cooled.

In this method, the c.c. strand and base metal in the tundish are connected and therefore subsequent treatment is troublesome. Moreover, if the c.c. strand is overcooled, the density of the c.c. strand is increased and bending deformation is apt to occur thereby damaging the inner surface of the mold when the remaining c.c. strand is taken out of the mold.

The above-mentioned disadvantages in the treatment of the final c.c. strand occur frequently when stainless steel with a c.c. strand of a high density is cast in a horizontal continuous casting process, and more or less also occurs in the case of general steel material.

SUMMARY OF THE INVENTION

In view of above-mentioned circumstances, the inventors have advanced the study of the prior art in order to establish a method in which treatment of the c.c. strand at the final stage is performed safely and smoothly, and damage at the inner surface of the mold is prevented to the extent possible. The present invention has been completed as a result of this study, and the invention is directed to the fact that when the level of molten steel within the tundish becomes lower than a prescribed level at a portion near the upper surface of the tundish nozzle in the final stage of the horizontal continuous casting process, a drawing of the c.c. strand is discontinued, and then, after a lapse of time t specified by following equation (I) drawing of the c.c. strand is again performed and the c.c. strand is broken at the feed nozzle.

$$0.02D^2 < t < 0.1D^2$$

wherein t: time (minute), and; D: inner diameter (cm) of feed nozzle.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENT

The constitution and working effect of the invention will now be described by way of examples referring to the accompanying drawings. Typical examples as hereinafter described do not restrict the invention, but suitable modification in specific structure of a tundish, a feed nozzle or a mold or detecting means of molten steel level within the spirit of the description shall be deemed to be included in the technical region of the invention.

Figure 1:
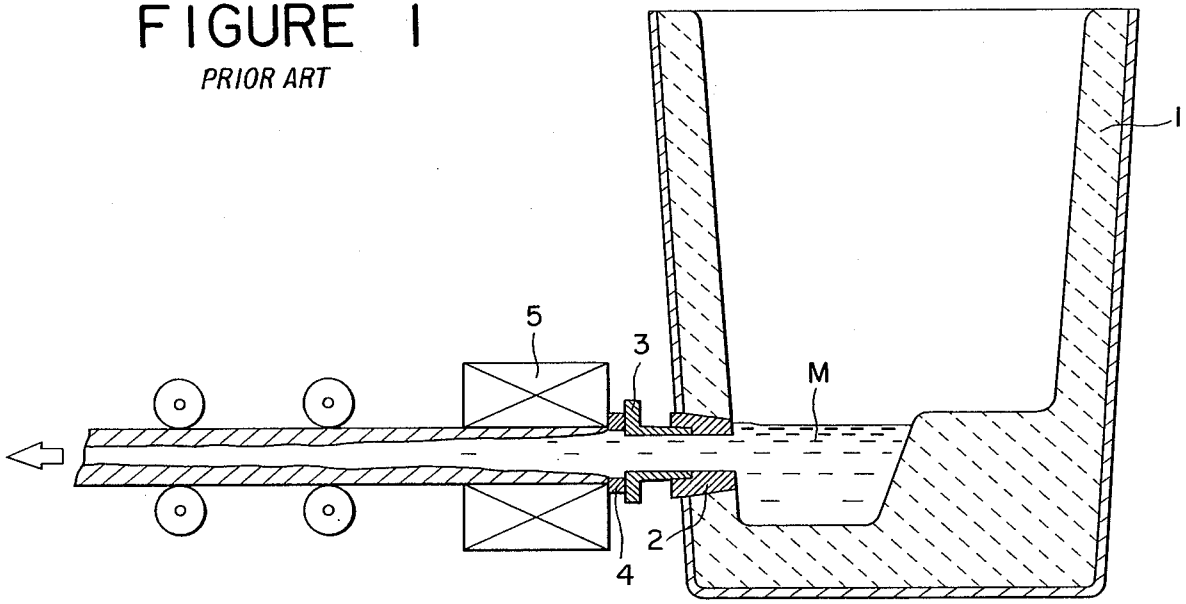
FIGURE 1 PRIOR ART
FIG. 1 is a schematic longitudinal sectional view illustrating the horizontal continuous casting process in the prior art.
Figure 2:
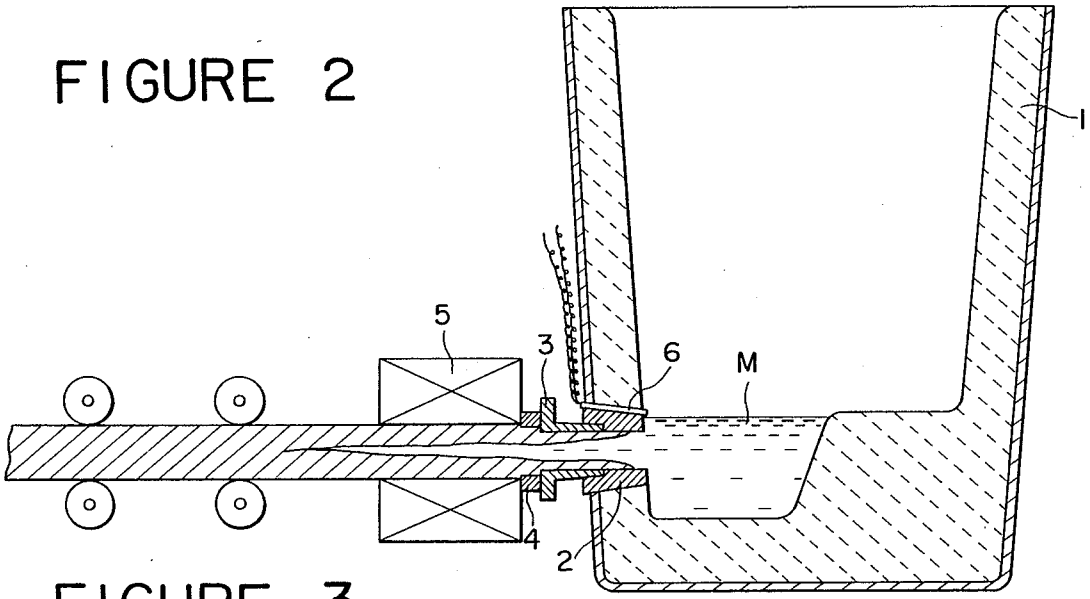
FIG. 2 is a schematic londitudinal sectional view of an embodiment of the invention illustrating a horizontal continuous casting process.
Figure 3:
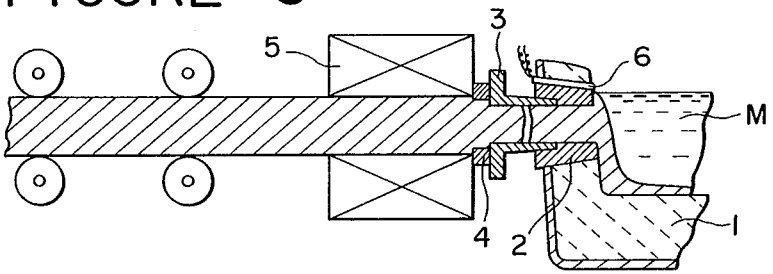
FIG. 3 is a londitudinal sectional view of the principal part of the inventive concept of FIG. 2.

FIG. 2 shows a schematic longitudinal sectional view of an embodiment of the invention, and FIG. 3 shows a longitudinal sectional view of a principal part of the inventive concept illustrating the breaking state of the c.c. strand when drawing is performed again. The casting equipment as a whole is shown in FIGS. 2 and 3 is substantially identical to an example shown in FIG. 1. In the present invention, however, a molten metal level detector 6 (a thermocouple in FIG. 2) is installed on the upper side of a tundish nozzle 2 so as to accurately detect the point in time when the level of molten steel remaining in the tundish becomes lower than that at the portion near the upper surface of the feed nozzle 3. In the thermocouple 6 of FIGS. 2 and 3, when the top end thereof contacts the molten steel M, the thermocouple indicates a high temperature corresponding to the molten steel temperature. To the contrary, when the molten steel level falls and the thermocouple is separated from the molten steel M, the detected temperature rapidly decreases and it can accordingly be accurately determined that the molten steel level has become lower than a prescribed level by routine inspection of the temperature. In addition to above-mentioned thermocouple, an ultrasonic system or float system may be adopted as a level detecting means. However, in view of circumstances where the detecting means directly contacts with molten steel at a relatively high temperature of 1500° C. or more, the thermocouple is most practicable regarding the necessary physical and mechanical property.

If it is determined that the molten steel level has become lower than that at portion near the upper surface line of the feed nozzle 3, intermittent drawing is stopped. As the stopping time lapses, solidification at the front of molten steel M is transferred from the feed nozzle 3 towards the tundish nozzle 2. In the present invention, the stopping time t is suitably controlled in relation to the inner dimension D of the feed nozzle 3 (D meaning diameter for a circular cross-section, the length of the minor side for a rectangular cross-section, and the radius of the minor axis for an elliptical cross-section, respectively) as hereinafter described in detail, and when the solidification front is transferred toward the tundish 1 from the feed nozzle 3, drawing begins again so as to break the c.c. strand at the feed nozzle 3 as shown in FIG. 3.

Figure 4:
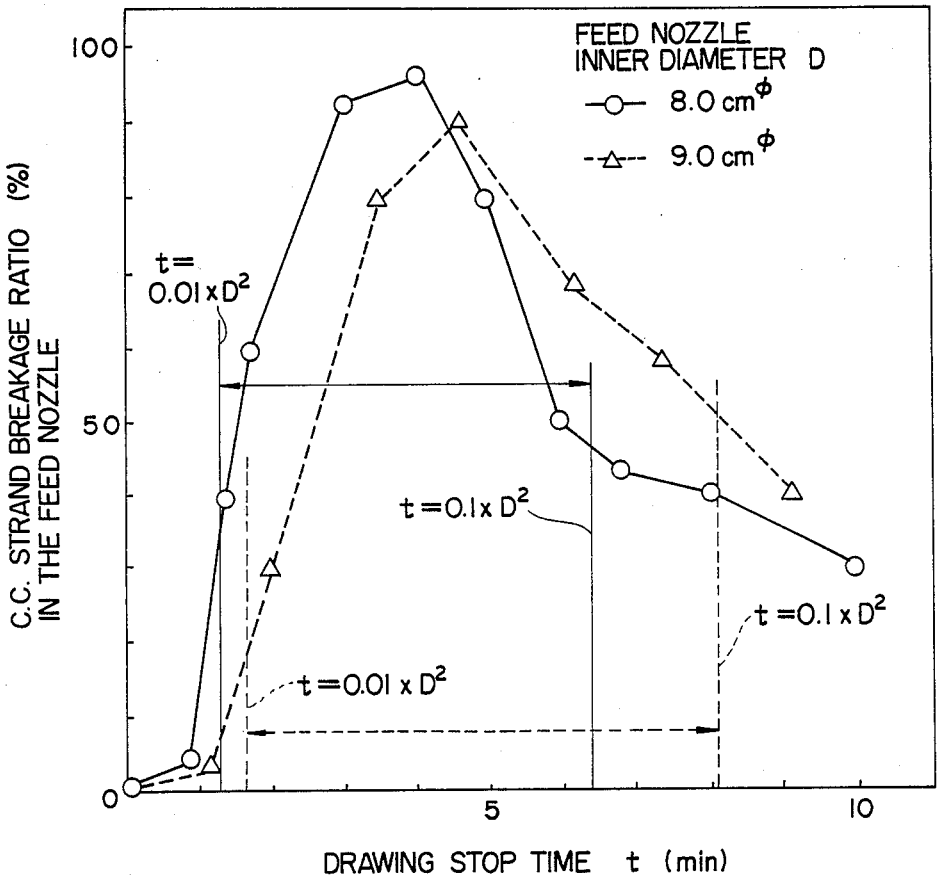
FIG. 4 is a graph of test results illustrating the relation between drawing stop time and a c.c. strand breakage ratio.
Figure 5:
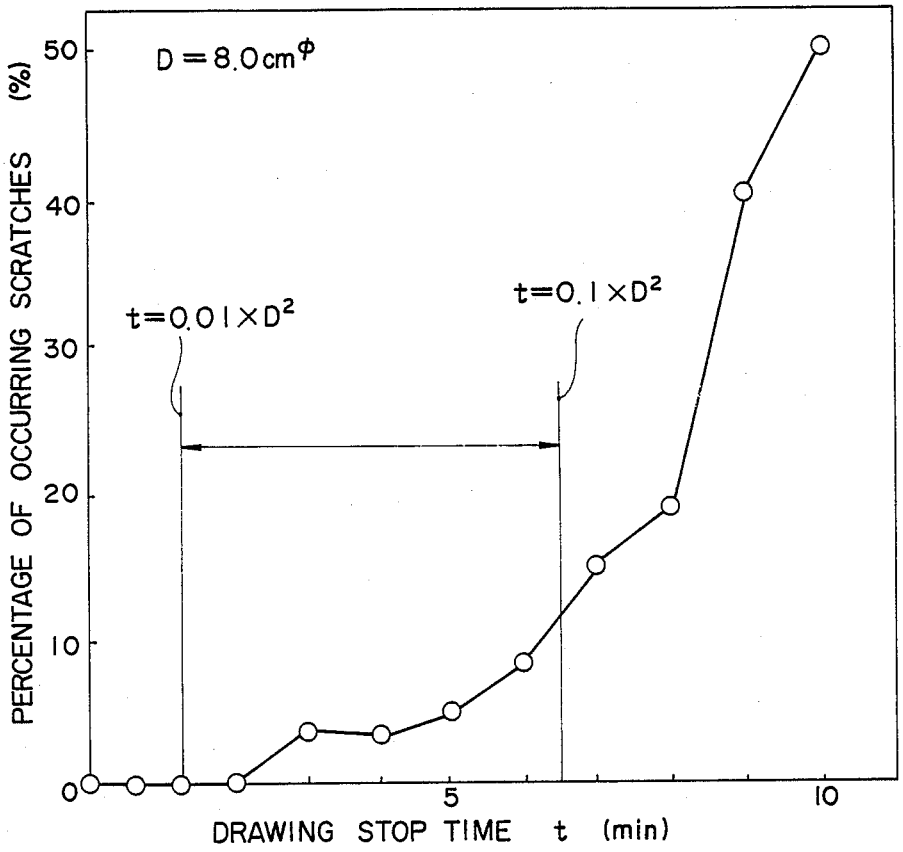
FIG. 5 is a graph of test results illustrating the relation between drawing stop time and the percentage of scratches occurring at the inner surface of the mold.

In order to break the c.c. strand securely at the feed nozzle 3 without producing leakage of molten steel under these circumstances, it is required that no non-solidified molten steel exists at the feed nozzle 3 but rather that the solidification be finished completely through to a center portion of the c.c. strand. Moreover, if the c.c. strand is overcooled, the strength of the c.c. strand is elevated as described in the third prior art method and the inner surface of the mold may be damaged when drawing is restarted. Therefore the time interval from the stopping of drawing to the beginning of subsequent drawing must be strictly controlled in view of above-mentioned requirements. As a result of experimentation, it has been confirmed that accurate control can be attained if the stop time t (sec) in relation to inner diameter D of the feed nozzle is adjusted to comply with above-mentioned equation (I). In this connection, FIG. 4 shows a graph of experiments illustrating the relation between the stopping time t and the c.c. strand breakage ratio (i.e. the probability of breakage of c.c. strand in the feed nozzle due to the drawing force of the c.c. strand), and FIG. 5 also shows a graph of experiments illustrating the relation between the stopping time and the percentage of scratches occuring at the inner surface of the mold. In the experiments, the molten steel comprised stainless steel (SUS 304), the size of c.c. strand was 110–150 mmϕ, and inner diameter D of the feed nozzle was 8 cm and 9 cm.

The reason why the c.c. strand breakage ratio at the feed nozzle decreases when $t<0.02\times D^2$ appears to be that solidification of molten steel within the mold is insufficient and therefore the breaking position of the c.c. strand is transferred toward the mold. As a result, the connecting refractory material or the mold may be damaged and leakage of non-solidified molten steel at the center portion may occur as already described in the third prior art method. On the other hand, when $t>0.1\times D^2$ the stopping time is too long thereby resulting in the c.c. strand and solidification shell in the tundish being completely connected the temperature of solidification shell in the nozzle decreases thereby strengthening the binding force between the c.c. strand and the solidification shell thus making breakage difficult. Therefore the probability of breakage of the c.c. strand occurring becomes low. Moreover, since the strength of the c.c. strand remaining in the mold is elevated and deformation of the c.c. strand occurs during cooling, the c.c. strand deeply scratches the inner surface of the mold when drawing is restarted and therefore the percentage of occurring scratches at the inner surface of the mold rapidly increases. However, if the stopping time t is set to be in the range $0.01\times D^2-0.1\times D^2$, the c.c. strand is broken at the feed nozzle without producing any leakage of molten steel, and thus there is little damage of the inner surface of the mold.

In addition, molten steel remaining in the tundish may be discharged out of the bottom thereof by suitable means or by becoming solidified within the tundish. The feed nozzle and tundish nozzle may be broken after the casting of a first charge and be repaired before the next charge.

The present invention is constituted as above described and consists of a method of stopping drawing of the c.c. strand at a final stage of the horizontal continuous casting process, and after a lapse of prescribed time has occurred the drawing is performed again and the c.c. strand is broken at the feed nozzle.

The present invention has various advantages as hereinafter described:

(1) Since a shutter or mechanism stopper is not required in the tundish nozzle, the corresponding cost of equipment is low.

(2) Since a cavity is not produced at rear end of the c.c. strand, the yield becomes high.

(3) There is no damage to the connecting refractory material or to the mold caused by leakage of molten metal and therefore the subsequent treatment is easy to perform.

(4) Damage to the inner surface of the mold is prevented when the drawing is performed again, if the stopping time is suitably controlled; and (5) Since the level of molten metal in the tundish is directed by using the level detector, the time frame for subsequent treatment is determined and the remaining amount of molten metal can be minimumized.

What is claimed is:

1. A method of treating a final continuously cast strand in a horizontal continuous casting process utilizing a feed nozzle with a circular cross-section and a tundish including a tundish nozzle and having molten metal disposed within said tundish, which comprises:

discontinuing drawing of said strand when the level of molten metal within said tundish becomes lower than a prescribed level at a portion near an upper surface of said tundish during a final stage of horizontal casting;

redrawing said strand after a lapse of time t in accordance with the equation:

$$0.02D^2 < t < 0.1D^2$$

wherein t denotes time in minutes and D denotes an inner diameter dimension in cm of said feed nozzle; and breaking said strand at said feed nozzle.

2. A method of treating a final continuously cast strand in a horizontal continuous casting process utilizing a feed nozzle with a rectangular cross-section and a tundish including a tundish nozzle and having molten metal disposed within said tundish, which comprises:

discontinuing drawing of said strand when the level of molten metal within said tundish becomes lower than a prescribed level at a portion near an upper surface of said tundish during a final stage of horizontal casting;

redrawing said strand after a lapse of time t in accordance with the equation:

$$0.02D^2 < t < 0.1D^2$$

wherein t denotes time in minutes and D denotes a length of a minor side in cm of said feed nozzle; and breaking said strand at said feed nozzle.

3. A method of treating a final continuously cast strand in a horizontal continuous casting process utilizing a feed nozzle with an elliptical cross-section and a tundish including a tundish nozzle and having molten metal disposed within said tundish, which comprises:

discontinuing drawing of said strand when the level of molten metal within said tundish becomes lower than a prescribed level at a portion near an upper surface of said tundish during a final stage of horizontal casting;

redrawing said strand after a lapse of time t in accordance with the equation:

$$0.02D^2 < t < 0.1D^2$$

wherein t denotes time in minutes and D denotes a radius of a minor axis in cm of said feed nozzle; and breaking said strand at said feed nozzle.

* * * * *